US008668090B2

(12) United States Patent
Taketomi et al.

(10) Patent No.: US 8,668,090 B2
(45) Date of Patent: Mar. 11, 2014

(54) POWDER CLASSIFYING DEVICE

(75) Inventors: Kenji Taketomi, Kanagawa (JP); Kazumi Kozawa, Saitama (JP); Masaru Kyugo, Saitama (JP)

(73) Assignee: Nisshin Seifun Group Inc., Tokyo (JP)

( * ) Notice: Subject to any disclaimer, the term of this patent is extended or adjusted under 35 U.S.C. 154(b) by 0 days.

(21) Appl. No.: 12/831,668

(22) Filed: Jul. 7, 2010

(65) Prior Publication Data

US 2010/0270214 A1 Oct. 28, 2010

Related U.S. Application Data

(62) Division of application No. 12/182,552, filed on Jul. 30, 2008, now Pat. No. 8,100,269.

(30) Foreign Application Priority Data

Jul. 31, 2007 (JP) ..... 2007-198548

(51) Int. Cl.
*B07B 4/00* (2006.01)
*B07B 7/00* (2006.01)

(52) U.S. Cl.
USPC ..... 209/135; 209/136; 209/138

(58) Field of Classification Search
USPC ..... 209/134, 135, 136, 137, 138, 139, 140, 209/141, 142, 143, 713, 714, 139.1
See application file for complete search history.

(56) References Cited

U.S. PATENT DOCUMENTS 1,464,113 A * 8/1923 Ryding ..... 55/432
2,188,431 A * 1/1940 Fraser ..... 209/139.2
2,616,563 A * 11/1952 Hebb ..... 209/722
2,702,632 A * 2/1955 Scott ..... 209/135
3,885,931 A * 5/1975 Schaller ..... 95/269
4,221,655 A * 9/1980 Nakayama et al. ..... 209/135
4,661,244 A * 4/1987 Hanke et al. ..... 209/139.2

(Continued)

FOREIGN PATENT DOCUMENTS

JP 6193880 12/1986
JP 06-083818 B 10/1995

(Continued)

OTHER PUBLICATIONS

Japanese Office Action dated Jan. 18, 2011 with partial English translation.

(Continued)

*Primary Examiner* — Stefanos Karmis
*Assistant Examiner* — Michael E Butler
(74) *Attorney, Agent, or Firm* — Whitham Curtis Christofferson & Cook, PC

(57) ABSTRACT

The powder classifying device classifies powder having a particle size distribution and collects the classified powder. The device includes a disc-like cavity to which the powder is supplied and where the supplied powder is classified, a powder supply port for supplying the powder to the cavity, guide vanes arranged so as to extend from an outer periphery of the cavity in an inner direction at a predetermined angle, a discharge unit for air streams including fine particles discharged from the cavity, a collection unit for coarse particles discharged from the cavity and air nozzles arranged below the guide vanes on an outer peripheral wall of the cavity along a tangential direction of the outer peripheral wall and blow compressed air into an inside of the cavity.

13 Claims, 6 Drawing Sheets

(56) References Cited

U.S. PATENT DOCUMENTS

| | | | | |
|---|---|---|---|---|
| 4,678,560 | A * | 7/1987 | Stole et al. | 209/23 |
| 4,869,786 | A * | 9/1989 | Hanke | 209/139.2 |
| 5,016,823 | A | 5/1991 | Kato et al. | |
| 5,533,629 | A * | 7/1996 | Ito et al. | 209/714 |
| 5,622,321 | A * | 4/1997 | Brundiek et al. | 241/79.1 |
| 5,816,509 | A * | 10/1998 | Ahn et al. | 241/39 |
| 6,269,955 | B1 * | 8/2001 | Morimoto et al. | 209/723 |
| 6,276,534 | B1 | 8/2001 | Huang et al. | |
| 6,607,079 | B2 * | 8/2003 | Laux | 209/143 |
| 6,616,734 | B2 * | 9/2003 | Liu | 95/282 |
| 6,827,221 | B1 * | 12/2004 | Brundiek et al. | 209/210 |
| 6,845,867 | B2 * | 1/2005 | Sussegger et al. | 209/151 |
| 7,866,582 | B2 * | 1/2011 | Nied | 241/5 |
| 7,985,292 | B2 * | 7/2011 | Panz et al. | 106/287.34 |
| 2004/0126141 | A1 * | 7/2004 | Mitchell et al. | 399/222 |
| 2009/0004590 | A1 * | 1/2009 | Yamamoto et al. | 430/110.3 |
| 2009/0090799 | A1 * | 4/2009 | Musch et al. | 241/57 |
| 2009/0261187 | A1 * | 10/2009 | Nied | 241/24.1 |
| 2009/0279715 | A1 * | 11/2009 | Jeong et al. | 381/92 |
| 2010/0187339 | A1 * | 7/2010 | Kannar et al. | 241/18 |

FOREIGN PATENT DOCUMENTS

| | | | |
|---|---|---|---|
| JP | 08-57424 | A | 3/1996 |
| JP | 11-138103 | | 5/1999 |
| JP | 11-314069 | | 11/1999 |
| JP | 2003-175343 | | 6/2003 |

OTHER PUBLICATIONS

Extended European Search Report dated Dec. 29, 2011.

* cited by examiner

POWDER CLASSIFYING DEVICE

CROSS-REFERENCE TO RELATED APPLICATIONS

This application is a division of U.S. patent application Ser. No. 12/182,552, filed Jul. 30, 2008, now issued as U.S. Pat. No. 8,100,269, and which is incorporated herein by reference.

The entire contents of all documents cited in this specification are incorporated herein by reference.

BACKGROUND OF THE INVENTION

The present invention related to a powder classifying device that classifies powder having a particle size distribution according to one or more desired particle sizes (classification points), and more particularly, to a powder classifying device that can classify powder preferably having sizes equal to or smaller than about several micrometers with a high degree of accuracy making use of a balance between centrifugal force given to the powder by circulating air streams and drag.

For example, a powder classifier as disclosed in JP 06-83818 B is known in which a powder input port is provided in the center of the upper surface, a powder path is formed along the conical surface spreading from the vertex of a cone provided right below the powder input port, the lower end of the powder path is located in substantially the center of a plurality of guide vanes arranged to extend at a predetermined angle from the circumferential edge toward the axial center, a center opening connected to an exhaust pipe is provided in the axial center below the cone and an air inlet is provided on the outer side periphery of the guide vanes, the guide vanes are divided into two stages including upper and lower stages by a partition plate, the powder path is opened between the guide vanes at the upper stage adjacent to each other, exhaust air discharged from the exhaust pipe causes air introduced through the air inlet to form a circulating stream when the air passes among the guide vanes, and powder is classified according to the balance between centrifugal force given by the circulating stream to the powder which falls from the powder path to spaces between the guide vanes, and drag.

Having the configuration described above, the powder classifier increases the powder processing ability while ensuring the circulating motion of powder owing to the circulating stream, and thus achieves the effects of uniform powder acceleration and an improvement in classification accuracy.

Air is flowed toward the guide vanes from the periphery to the center thereof, i.e., along the radial direction, then its direction of flow is changed by the guide vanes. Therefore, the guide vanes can reliably change the direction in which the air is flowed and therefore the classification point.

Moreover, since the guide vanes are provided in the two upper and lower stages, powder having been charged into the spaces between the guide vanes is guided to a classifying zone integrally with air streams without being precipitated. Therefore the powder is classified in a uniformly mixed state while improving the classification accuracy.

JP 08-57424 A discloses a material supply device suitably applied to a device (pneumatic classifier) in which a material supply cylinder is provided in the upper part of a classifying chamber, a material is supplied into the material supply cylinder and circulated, causing the material to move downward and be introduced through a supply hole provided on a lower outer periphery of the material supply cylinder into the classifying chamber where it is classified. In the material supply device, a plurality of guide vanes inclined in a direction of circulation of the material are annularly arranged on the outer periphery of the material supply cylinder and secondary air inlet passages are provided between the guide vanes adjacent to each other.

With the material supply device, when the material is supplied into the material supply cylinder and circulated, secondary air is introduced into the material supply cylinder through the secondary air inlet passages between the guide vanes. Consequently, a dispersion force can be imparted to the material and a semi-free vortex can be formed inside the material supply cylinder, which enables the powder material to be supplied in a dispersed state into the classifying chamber at high speed.

JP 11-138103 A discloses a pneumatic classifier which is similar to the device disclosed in JP 08-57424 A. A classifying cover and a classifying plate are respectively provided in upper and lower parts of the pneumatic classifier in a such a conical shape that the lower surface of the classifying cover and the upper surface of the classifying plate have larger heights toward the centers thereof. A plurality of louvers (which are similar to the guide vanes provided in the device disclosed in. JP 08-57424 A) are annularly arranged on the outer periphery of a classifying chamber formed between the conical lower surface and the conical upper surface, an inlet passage for secondary air is provided between adjacent louvers, powder supplied into the classifying chamber is circulated at high speed and centrifuged into fine particles and coarse particles, the fine particles are discharged from a fine particle discharge cylinder connected to the center portion of the classifying plate, whereas the coarse particles are discharged from a coarse particle discharge port formed on the outer periphery of the classifying plate. In this device, "the inclination angle of the conical lower surface of the classifying cover is set larger than that of the conical upper surface of the classifying plate".

In recent years, along with the advance of technologies, fine particles having a narrow particle size distribution are more often required.

Of the powder classifier disclosed in JP 06-83818 B, the pneumatic classifier employing the material supply device disclosed in JP 08-57424 A, and the pneumatic classifier disclosed in JP 11-138103 A, the pneumatic classifier disclosed in JP 11-138103 A can be applied to the above-mentioned purpose of obtaining fine particles having a narrow particle size distribution.

However, the conventional powder classifier and the pneumatic classifiers include a large conical material supply unit or classifying unit. Therefore, the structure (manufacturing process) of the devices is complicated. When powder having high adhesion properties or particulates on the order of microns (equal to or smaller than about several micrometers) or sub-microns are classified, a satisfactory result cannot be obtained in terms of classification accuracy and operability (or particle size controllability).

SUMMARY OF THE INVENTION

The present invention has been made in view of the above circumstances and it is an object of the present invention to solve the conventional problems by providing a powder classifying device that can classify particulates having sizes equal to or smaller than about several micrometers or sub-micron sized particulates with a high degree of accuracy, and offers easy particle size control and maintenance.

In to achieve the above object, according to a first aspect of the present invention, there is provided a powder classifying device which classifies powder having a particle size distribution and having been supplied and collects the classified powder, the powder classifying device comprising: a disc-like cavity to which the powder having the particle size distribution is supplied and where the supplied powder is classified; a powder supply port for supplying the powder having the particle size distribution to the disc-like cavity; a plurality of guide vanes arranged so as to extend from an outer periphery of the disc-like cavity in an inner direction at a predetermined angle; a discharge unit for air streams including fine particles discharged from the disc-like cavity; a collection unit for coarse particles discharged from the disc-like cavity; and a plurality of air nozzles that are arranged below the plurality of guide vanes on an outer peripheral wall of the disc-like cavity along a tangential direction of the outer peripheral wall and blow compressed air into an inside of the disc-like cavity.

Preferably, a direction in which the air streams are guided is integrally adjustable with the plurality of guide vanes.

Preferably, the powder classifying device further comprises a ring-like edge provided in a central portion of at least one of an upper surface and a lower surface in the disc-like cavity.

According to a second aspect of the present invention, there is provided a powder classifying device which classifies powder having a particle size distribution and having been supplied and collects the classified powder, the powder classifying device comprising: a first annular cavity to which the powder having the particle size distribution is supplied; a powder supply port for supplying the powder having the particle size distribution to the first annular cavity; a plurality of first air nozzles that are arranged on a first outer peripheral wall of the first annular cavity along a tangential direction of the first outer peripheral wall and blow compressed air into an inside of the first annular cavity; a disc-like cavity which is located below the plurality of first air nozzles and where the powder having the size distribution and having been supplied is classified; a plurality of guide vanes arranged so as to extend from an outer periphery of the disc-like cavity in an inner direction at a predetermined angle; a discharge unit for air streams including fine particles discharged from the disc-like cavity; a collection unit for coarse particles discharged from the disc-like cavity; and a plurality of second air nozzles that are arranged below the plurality of guide vanes on a second outer peripheral wall of the disc-like cavity along a tangential direction of the second outer peripheral wall and blow compressed air into an inside of the disc-like cavity.

The plurality of first air nozzles are preferably arranged in the first annular cavity to form a dispersing zone for the supplied powder having the particle size distribution in the first annular cavity.

Preferably, the powder classifying device further comprises a second annular cavity arranged below the disc-like cavity, and the plurality of second air nozzles are arranged in the second annular cavity to form in the disc-like cavity a classifying zone for the powder having been dispersed.

Preferably, the plurality of first air nozzles are arranged in the first annular cavity, and the plurality of second air nozzles are arranged in the second annular cavity to disperse and classify the powder having the particle size distribution that was supplied into the disc-like cavity located between the first annular cavity and the second annular cavity.

Preferably, a direction in which the air streams are guided is integrally adjustable with the plurality of guide vanes.

Preferably, the powder classifying device further comprises a ring-like edge in a central portion of at least one of an upper surface- and a lower surface in the disc-like cavity.

According to a third aspect of the present invention, there is provided a powder classifying device which classifies powder having a particle size distribution and having been supplied and collects the classified powder, the powder classifying device comprising: an upright disc-like cavity to which the powder having the particle size distribution is supplied and where the supplied powder is classified; a powder supply port for supplying the powder having the particle size distribution to the upright disc-like cavity; a plurality of guide vanes provided in the upright disk-like cavity so as to extend from an outer periphery of the upright disc-like cavity in an inner direction at a predetermined angle; a plurality of air nozzles that are arranged on an outer peripheral wall of the disc-like cavity along a tangential direction of the outer peripheral wall and blow compressed air into an inside of the upright disc-like cavity from both surfaces of the upright disc-like cavity;

a discharge unit for air streams including fine particles discharged from the upright disc-like cavity; and a collection unit for coarse particles discharged from the upright disc-like cavity.

Preferably, the powder classifying device further comprises a ring-like edge provided in a central portion of at least one of opposing surfaces in the upright disc-like cavity.

According to a fourth aspect of the present invention, there is provided a powder classifying device which classifies powder having a particle size distribution and having been supplied and collects the classified powder, the powder classifying device comprising: a first disc-like cavity to which the powder having the particle size distribution is supplied; a powder supply port, for supplying the powder having the particle size distribution to the first disc-like cavity, a plurality of first air nozzles that are arranged on a first outer peripheral wall of the first disc-like cavity along tangential direction of the first outer peripheral wall and blow compressed air into an inside of the first disc-like cavity; a plurality of first guide vanes provided below the plurality of first air nozzles so as to extend from an outer periphery of the first disc-like cavity in an inner direction at a predetermined angle; a discharge unit for air streams including fine particles discharged from the first disc-like cavity; a second disc-like cavity that receives air streams from the first disc-like cavity including a part of the powder which has such a particle size distribution and is the remainder of the powder that is not discharged through the discharge unit, and classifies the part of the powder included in the received air stream and having such the particle size distribution; a plurality of second air nozzles that are arranged on a second outer peripheral wall of the second disc-like cavity along a tangential direction of the second outer peripheral wall and blow compressed air into an inside of the second disc-like cavity; a plurality of second guide vanes arranged so as to extend from an outer periphery of the second disc-like cavity at a predetermined angle; a plurality of third air nozzles that are arranged below the plurality of second guide vanes, on the second outer peripheral wall of the second disc-like cavity along the tangential direction of the second outer peripheral wall, and blow compressed air into the inside of the second disc-like cavity; and a collection unit for coarse particles discharged from the second disc-like cavity.

Preferably, the powder classifying device further comprises, in a central portion of the second disc-like cavity, a medium particle collection unit that collects particles having sizes equal to or smaller than a classification point set in a lower centrifugal chamber having the second disc-like cavity as a main component.

Preferably, the powder classifying device further comprises a ring-like edge provided in a central portion of at least one of an upper surface and a lower surface in the first disc-like cavity.

At least one of the plurality of air nozzles is preferably provided so as to communicate with the powder supply port.

The present invention is highly effective in realizing a powder classifying device that is capable of classifying particulates having sizes equal to or smaller than about several micrometers and sub-micron sized particulates with a high degree of accuracy and offers easy particle size control and maintenance.

More specifically, the present invention is highly effective in realizing a powder classifying device which has such a structure that a plurality of air nozzles are arranged on the outer peripheral wall of the disc-like cavity along the tangential direction of the outer peripheral wall and blow compressed air into the disc-like cavity, and which is advantageous in producing powder having sizes equal to or smaller than about several micrometers or on the order of sub-microns.

The powder classifying device according to the third aspect of the present invention, i.e., the powder classifying device in which the centrifugal chamber is vertically arranged is advantageous in that this powder classifying device requires a considerably reduced area for its installation compared with the case of a powder classifying device in which a centrifugal chamber of the same processing ability is horizontally arranged. The powder classifying device according to the fourth aspect of the present invention, i.e., the two-stage device having two powder classifying devices of the same size placed one on top of another is also effective in reducing the installation area.

DETAILED DESCRIPTION OF THE PREFERRED EMBODIMENTS

A powder classifying device according to the present invention will be hereinafter explained in detail with reference to the accompanying drawings.

Figure 1A:
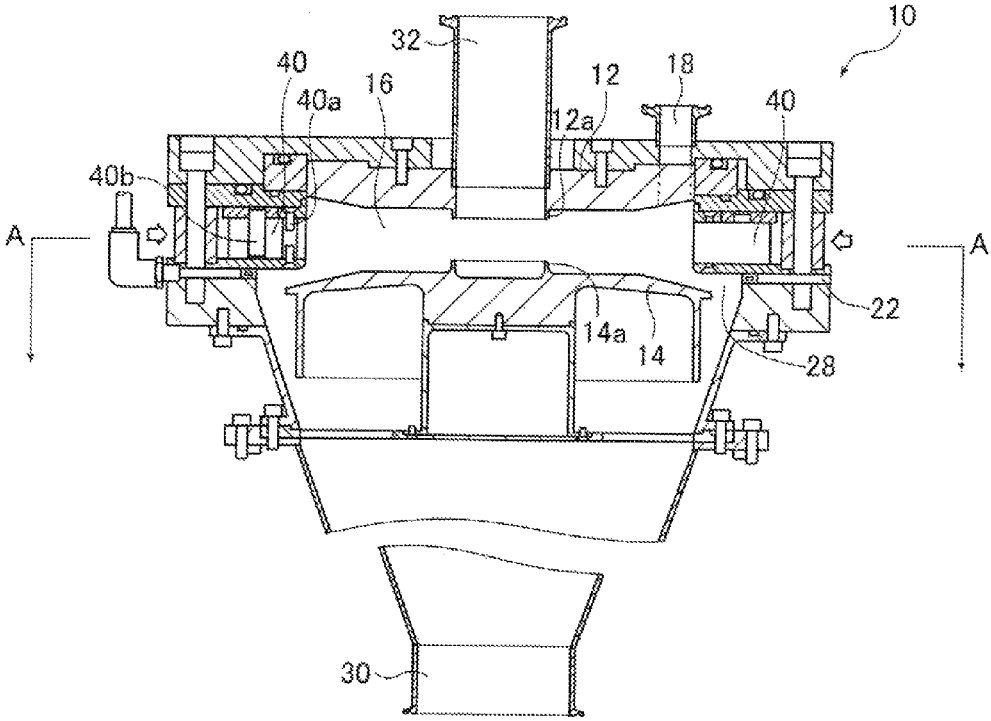
FIG. 1A is a sectional view illustrating the configuration of a powder classifying device according to an embodiment of the present invention taken along a plane passing through its central axis.
Figure 1B:
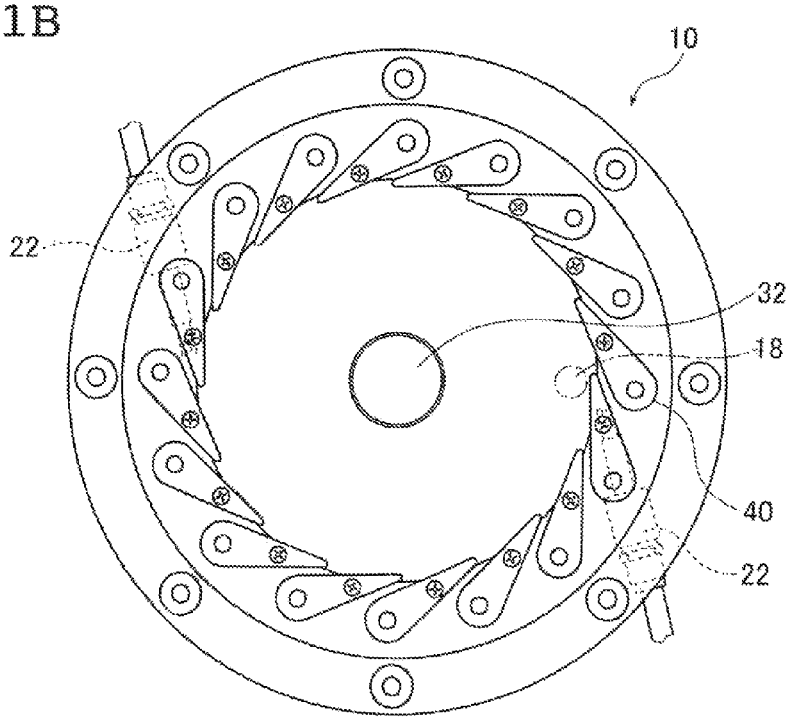
FIG. 1B is a sectional view taken along the line A-A of FIG. 1A.

FIGS. 1A and 1B are schematic views of a powder classifying device according to a first embodiment of the present invention for explaining the basic principle of the present invention. FIG. 1A is a sectional view of the powder classifying device taken along a plane passing through its central axis, and FIG. 1B is a sectional view taken along the line A-A of FIG. 1A. A material input port 18 described later is essentially not included in FIG. 1B. However, to clarify the relative positional relationship of the material input port 18 with other components (in particular, guide vanes 40 and discharge nozzles 22 that discharge high-pressure air as described later), the material input port 18 and the discharge nozzles 22 are particularly indicated by imaginary lines and dotted lines.

A powder classifying device 10 according to the embodiment shown FIGS. 1A and 1B includes a disc-like centrifugal chamber 16, which also serves as a material dispersing zone and is formed by arranging an upper disc-like member 12 and a lower disc-like member 14 in a face-to-face relationship while keeping a predetermined space therebetween. The material input port 18 is arranged above the centrifugal chamber 16 at a position where it does not interfere with the guide vanes 40 described later.

Below the centrifugal chamber 16, a material re-classifying zone 28 of a toroidal shape and a coarse particle collection port 30 are formed along the outer peripheral wall of the lower disc-like member 14. A plurality of discharge nozzles 22 are arranged along the tangential direction of the outer peripheral wall of the material re-classifying zone 28. The discharge nozzles 22 are nozzles that disperse a material in the centrifugal chamber 16 and discharge high-pressure air for accelerating a centrifugal action in the centrifugal chamber 16.

In an exemplary layout, six discharge nozzles 22 are arranged on the circumference at equal intervals. However, this is only by way of illustration and the discharge nozzles 22 can be arranged with a certain degree of flexibility.

A fine particle collection port 32 connected to a suction blower (hot shown) via an appropriate filter such as a bag filter and the coarse particle collection port 30 that extends downward from the material re-classifying zone 28 are formed within the centrifugal chamber 16.

Both of the lower surface on the upper side and the upper surface cm the lower side in the central portion of the centrifugal chamber 16 have ring-like edges 12*a* and 14*a* extending therefrom upward and downward, respectively.

The ring-like edges 12*a* and 14*a* determine the classification performance in the powder classifying device 10 according to this embodiment. Sufficient consideration is necessary to determine the positions at which the edges are formed and their heights.

The plurality of guide vanes 40 (sixteen guide vanes in this case) are arranged on the outer periphery of the centrifugal chamber 16. These guide vanes 40 have a function of adjusting the circulating speed of powder centrifuged, while it circulates in the centrifugal chamber 16 and moves downward. The guide vanes 40 are axially supported by pivotal shafts 40*a* for their pivotal movement between the upper disc-like member 12 and the lower disc-like member 14 and are locked by pins 40*b* to a not-shown pivotal plate (pivoting means). It is possible to simultaneously turn all the guide vanes 40 by a predetermined angle by pivoting the pivotal plate (pivoting means).

The pivotal plate (pivoting means) is thus pivoted to turn the guide vanes 40 by the predetermined angle, thus making it possible to adjust the distances between the guide vanes 40 and change the flow rate of air passing therethrough. Consequently, the classification performance (specifically, classification point) in the powder classifying device 10 according to this embodiment can be changed.

The guide vanes 40 are arranged on the outer periphery of the centrifugal chamber 16 and their further outer peripheral portion is not provided with any component such as a side-wall. Air filters for preventing dust from entering the powder classifying device 10 and reducing noise are desirably provided.

The blower provided in a fine particle collection unit blows out air to reduce the internal pressure of the centrifugal chamber 16. Therefore, air around the centrifugal chamber 16 is introduced into the centrifugal chamber 16 (see white arrows) through the air filters. As a result, the air filters have a function of increasing the amount of air used for centrifugal separation in the centrifugal chamber 16.

The powder classifying device 10 according to the first embodiment of the present invention is configured as described above and its operations are described below.

It is confirmed that the fine particle collection unit and a coarse particle collection unit are connected to the fine particle collection port 32 and the coarse particle collection port 30 of the powder classifying device 10, respectively. Then, the angles of the guide vanes 40 are set to a predetermined value and compressed air is discharged from the discharge nozzles 22 connected to a compressed air source under predetermined conditions In this state, powder material to be classified is introduced into the device through the material input port 18 at a predetermined flow rate. The thus introduced powder material is flowed in the centrifugal chamber 16 on the stream circulating at high speed within the chamber 16 by the action of compressed air discharged from the discharge nozzles 22, then dispersed and classified therein.

In this process, outside air is sucked into the centrifugal chamber 16 through the spaces between the guide vanes 40 arranged on the outer periphery of the centrifugal chamber 16 (see white arrows) to promote the centrifugal action in the centrifugal chamber 16.

As a result of the centrifugal action in the centrifugal chamber 16, basically, particulates (fine particles) having sizes equal to or smaller than the classification point are collected through the fine particle collection port 32 in the fine particle collection unit located outside the device while the ring-like edges 12*a* and 14*a* in the central portion of the centrifugal chamber 16 keep coarser particles in the powder material from being collected with the fine particles. The collected particulates (fine particles) rarely include coarse particles whose sizes exceed the classification point.

On the other hand, as a result of the centrifugal action in the centrifugal chamber 16, in practice, it is highly probable that fine particles are included in the coarse particles having sizes exceeding the classification point. This is inevitable in the centrifugal process. However, in the powder classifying device according to the present invention, in order to solve this problem, the discharge nozzles 22 are provided at the entrance portion of the material re-classifying zone 28 below the centrifugal chamber 16. Fine particles flowing into the material re-classifying zone 28 are returned into the centrifugal chamber 16 by air streams from the discharge nozzles 22.

The coarse particles from which the fine particles have been efficiently removed by the above-mentioned re-classifying operation with the discharge nozzles 22 are collected from the material re-classifying zone 28 through the coarse particle collection port 30 into the coarse particle collection unit.

This is the operational point of the powder classifying device according to the first embodiment of the present invention.

With the powder classifying device according to this embodiment, outside air is sucked into the device through the spaces between the guide vanes 40 arranged on the outer periphery of the centrifugal chamber 16 (see white arrows) to promote the dispersing and centrifugal actions in the centrifugal chamber 16. Therefore, it is possible to realize a powder classifying device which is advantageous in producing powder having sizes equal to or smaller than about several micrometers or sub-micron sized particulates while effectively preventing mixing of fine particles with coarse particles.

Next, other embodiments of the powder classifying device according to the present invention are described.

Figure 2:
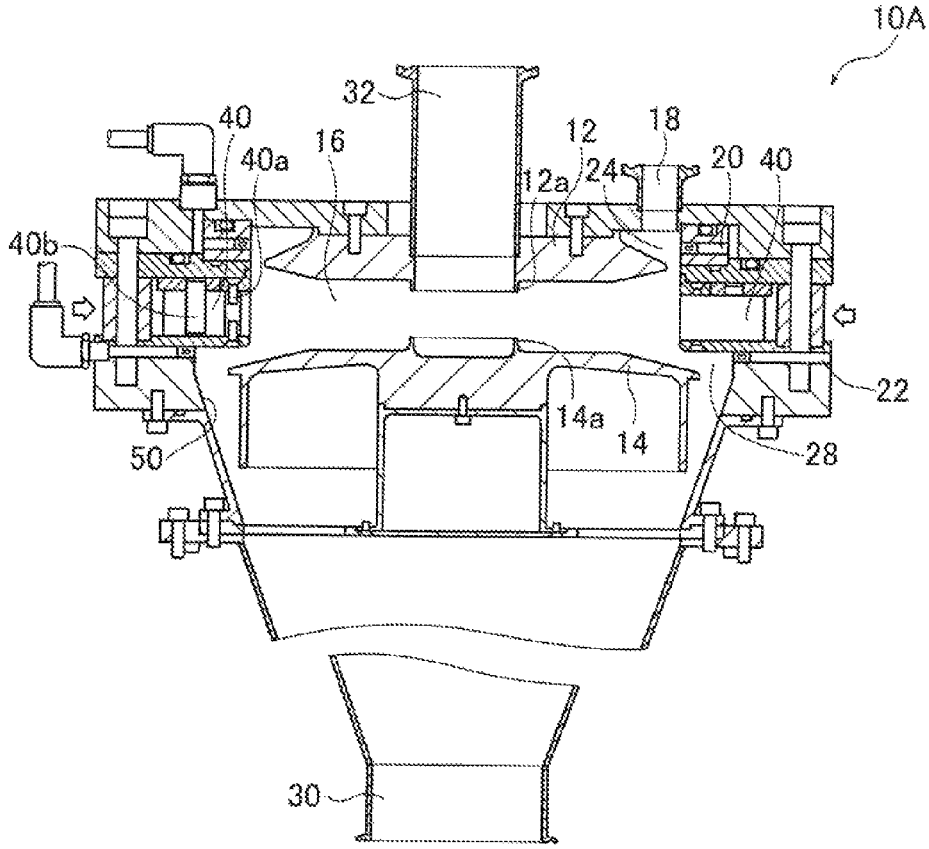
FIG. 2 is a schematic sectional view of a powder classifying device according to another embodiment of the present invention.

FIG. 2 is a schematic sectional view of a powder classifying device according to a second embodiment of the present invention.

A powder classifying device 10A according to the embodiment shown in FIG. 2 basically includes, as in the powder classifying device 10 shown in FIGS. 1A and 1B, a disc-like centrifugal chamber 16 formed by arranging an upper disc-like member 12 and a lower disc-like member 14 in a face-to-face relationship while keeping a predetermined space therebetween. Therefore, to avoid repetitive description, components having the same functions as those in the first embodiment are denoted by the same reference numerals and symbols and their description is omitted.

The centrifugal chamber 16 has a material dispersing zone 24 formed on its upper side along a material input port 18 and the outer peripheral wall of the upper disc-like member 12 as well as a material re-classifying zone 28 formed on its lower side along the outer peripheral wall of the lower disc-like member 14.

In the material dispersing zone 24, discharge nozzles (first nozzles) 20 for discharging high-pressure air for material dispersion are arranged on the outer peripheral wall thereof along the tangential direction of the outer peripheral wall. In the material re-classifying zone 28, the discharge nozzles (second nozzles) 22 for discharging high-pressure air for accelerating the centrifugal action are arranged on the outer peripheral wall thereof along the tangential direction of the outer peripheral wall.

In the powder classifying device 10A according to this embodiment, the following points are taken into account in the method of arranging the discharge nozzles in two parts, that is, the discharge nozzles (first nozzles) 20 and the discharge nozzles (second nozzles) 22. The first nozzles 20 are arranged on the outer peripheral wall of the material dispersing zone 24 and the second nozzles are arranged the outer peripheral wall of the material re-classifying zone 28, each along the tangential direction thereof. In this case, satisfactory results are obtained by setting, as to inclination angles of the first and second nozzles from the tangential directions toward the center of the device, the inclination angle of the discharge nozzles (second nozzles) 22 slightly larger than the inclination angle of the discharge nozzles (first nozzles) 20.

In other words, the toroidal material dispersing zone 24 is formed above the centrifugal chamber 16 at a position where it faces air discharge holes of the first nozzles 20 and the toroidal material re-classifying zone 28 is formed below the centrifugal chamber 16 at a position where it faces air discharge holes of the second nozzles 22.

A coarse particle collection port 30 which communicates with a coarse particle collection unit (not shown) through a toroidal coarse particle collection channel is formed below the material re-classifying zone 28. On the other hand, a fine particle collection port 32 communicating with a fine particle collection unit (not shown) is formed above the centrifugal chamber 16. The fine particle collection port 32 is usually connected to a suction blower via an appropriate filter such as a bag filter.

Both of the lower sulfate on the upper side and the upper surface on the lower side in the central portion of the centrifugal chamber 16 have ring-like edges 12*a* and 14*a* extending therefrom upward and downward, respectively.

The ring-like edges 12*a* and 14*a* determine the classification performance in the powder classifying device 10A according to this embodiment. Sufficient consideration is necessary to determine the positions at which the edges are formed and their heights.

Guide vanes 40 of the same type as those in the first embodiment are arranged on the outer periphery of the centrifugal chamber 16. The guide vanes 40 are axially supported by pivotal shafts 40*a* for their pivotal movement between the upper disc-like member 12 and the lower disc-like member 14 and are locked by pins 40*b* to a not-shown pivotal plate (pivoting means). It is possible to turn all the guide vanes 40 by a predetermined angle by pivoting the pivotal plate (pivoting means).

The first nozzle 20 preferably has an inclination angle of 45 to 90 degrees with respect to the direction vertical to a surface which is opposed to the air discharge hole of the first nozzle 20 in wall surfaces of the toroidal material dispersing zone 24 formed at the position at which the zone 24 faces the air discharge hole of the first nozzle 20.

Consequently, a significant effect is achieved in preventing fine particles from being mixed with coarse particles to be separated toward the coarse particle collection unit, although such fine particles should essentially be separated toward the fine particle collection unit.

The powder classifying device 10A according to the second embodiment of the present invention is configured as described above and its operations are described below.

It is confirmed that the fine particle collection unit and the coarse particle collection unit are connected to the fine particle collection port 32 and the coarse particle collection port 30 of the powder classifying device 10A, respectively. Then, the angles of the guide vanes 40 are set to a predetermined value and compressed air is discharged from the first nozzles 20 and the second nozzles 22 connected to a compressed air source under predetermined conditions.

In this state, powder material to be classified is introduced into the device through the material input port 18 at a predetermined flow rate. The thus introduced powder material is flowed in the toroidal material dispersing zone 24 on the stream circulating at high speed within the zone 24 by the action of compressed air discharged from the first nozzles 20 and falls into the centrifugal chamber 16 while being preliminarily dispersed.

In this process, outside air is sucked into the centrifugal chamber 16 through the spaces between the guide vanes 40 arranged on the outer periphery of the centrifugal chamber 16 (see white arrows) to promote the centrifugal action in the centrifugal chamber 16.

As a result of the centrifugal action in the centrifugal chamber 16, basically, particulates (fine particles) having sizes equal to or smaller than the classification point are collected through the fine particle collection port 32 in the fine particle collection unit located outside the device while the ring-like edges 12*a* and 14*a* in the central portion of the centrifugal chamber 16 keep coarser particles in the powder material from being collected with the fine particles. The collected particulate (fine particles) rarely include coarse particles whose sizes exceed the classification point.

On the other hand, as a result of the centrifugal action in the centrifugal chamber 16, in practice, it is highly probable that fine particles are included in the coarse particles having sizes exceeding the classification point. This is inevitable in the centrifugal process. However, in the powder classifying device according to the present invention, in order to solve this problem, the second nozzles 22 are provided at the entrance portion of the material re-classifying zone 28 below the centrifugal chamber 16. Fine particles flowing into the material re-classifying zone 28 are returned into the centrifugal chamber 16 by air streams from the second nozzles 22.

The coarse particles from which the fine particles have been efficiently removed, by the re-classifying operation with the second nozzles 22 are collected in the coarse particle collection unit through the material re-classifying zone 28.

This is the operational point of the powder classifying device according to the second embodiment of the present invention.

With the powder classifying device according to this embodiment, outside air is sucked into the device through the spaces between the guide vanes 40 arranged on the outer periphery of the centrifugal chamber 16 (see white arrows) to promote the centrifugal action in the centrifugal chamber 16. In addition, an auxiliary classification function unit 50 delimited by an inclined part below the second nozzles 22 of the material re-classifying zone 28 effectively prevents mixing of fine particles with coarse particles to realize a powder classifying device which is advantageous in producing powder having sizes equal to or smaller than about several micrometers or sub-micron sized particulates.

Next, the configuration of a powder classifying device according to still another embodiment of the present invention is described.

Figure 3:
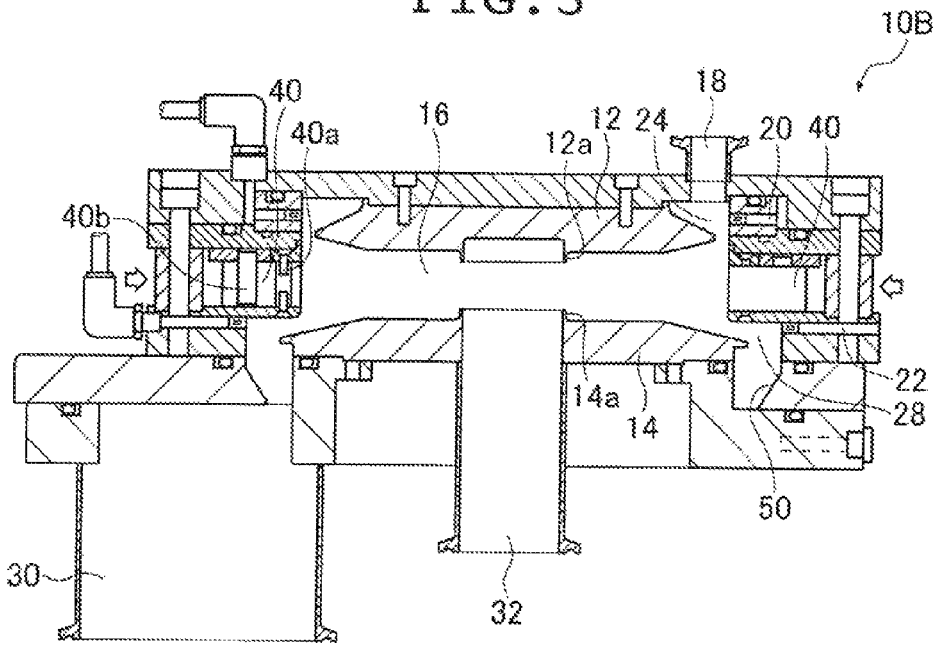
FIG. 3 is a schematic sectional view of a powder classifying device according to still another embodiment of the present invention.

A powder classifying device 10B shown in FIG. 3 is configured in such a manner that classified fine particles are collected in the same direction as coarse particles, that is, downward, although classified fine particles are collected in the direction opposite to coarse particles, that is, upward in the case shown in FIG. 2.

The present invention is advantageous in that the direction in which classified particles are collected can be easily changed to flexibly cope with the place where the powder classifying device is to be installed.

In view of this, the components in FIG. 3 which are the same as those used in the device shown in FIG. 2 are denoted by the same reference numerals and symbols and their detailed description is omitted.

The powder classifying device 10B shown in FIG. 3 collects fine particles discharged downward from the central portion of the centrifugal chamber 16 through the fine particle collection port 32 in the fine particle collection unit which is outside the device. As in the device shown in FIG. 2, the fine particle collection port 32 is connected to a suction blower via an appropriate filter such as a bag filter.

With the powder classifying device according to the embodiment shown in FIG. 3, as in the embodiment described above, outside air is sucked into the device through the spaces between the guide vanes 40 arranged on the outer periphery of the centrifugal chamber 16 (see white arrows) to promote the centrifugal action in the centrifugal chamber 16. In addition, an auxiliary classification function unit 50 delimited by an inclined part below the second nozzles 22 of the material re-classifying zone 28 effectively prevents mixing of fine particles with coarse particles to realize a powder classifying device which is advantageous in producing powder having sizes equal to or smaller than about several micrometers or sub-micron sized particulates.

Figure 4:
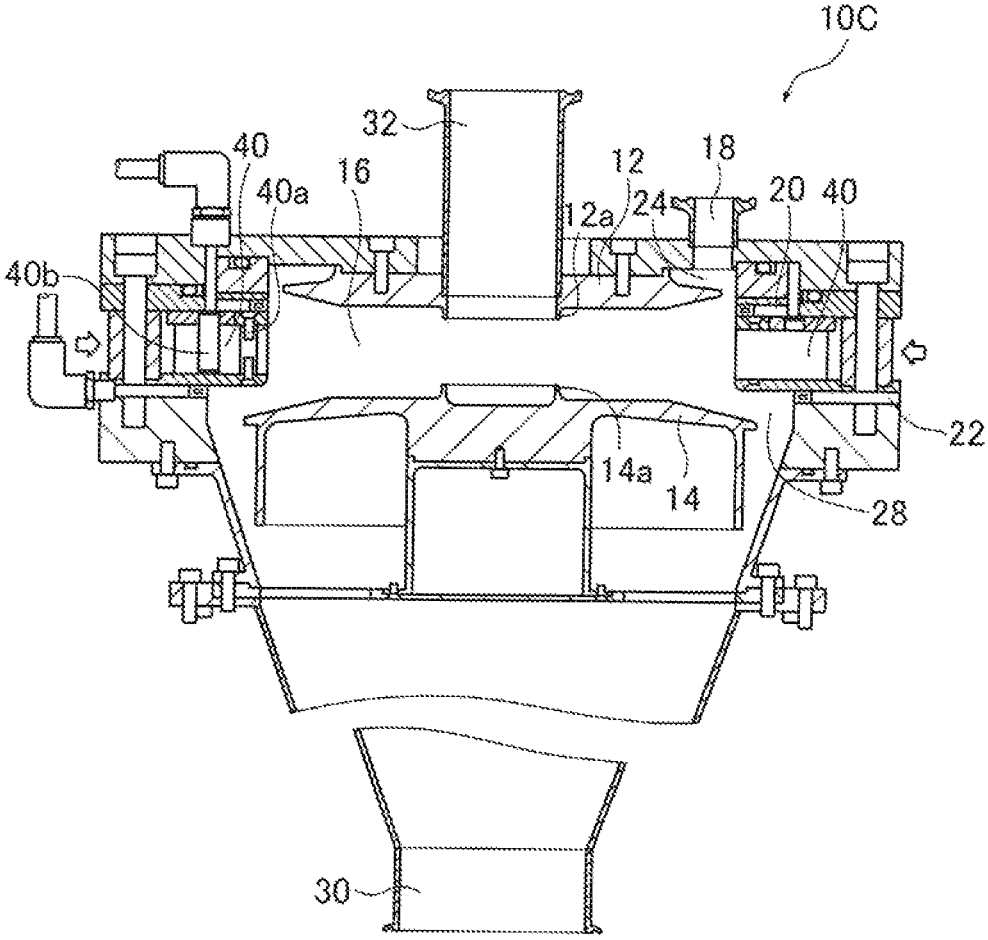
FIG. 4 is a schematic sectional view of a powder classifying device according to yet another embodiment of the present invention.

A powder classifying device according to yet another embodiment of the present invention is described with reference to FIG. 4.

A powder classifying device 10C according to this embodiment is obtained by slightly modifying the powder classifying device shown in FIG. 2. The powder classifying device 10C is modified so that the first nozzles 20 and the second nozzles 22 are arranged at positions at which they are substantially vertically symmetrical with respect to the centrifugal chamber 16 and the guide vanes 40.

More specifically, in the powder classifying device 10A shown in FIG. 2, the first nozzles 20 are located at higher positions in a vertical direction of the centrifugal chamber 16 so as to discharge compressed air on the upper surface of the upper disc-like member 12, whereas in the powder classifying device 10C, the first nozzles 20 are located at slightly lower positions so as to be vertically symmetrical to the second nozzles 22.

Any further substantial-modification is not made to the configuration.

With the powder classifying device according to this embodiment, outside air is sucked into the device through the spaces between the guide vanes 40 arranged on the outer periphery of the centrifugal chamber 16 (see white arrows) to promote the centrifugal action in the centrifugal chamber 16. In addition, the first nozzles 20 are moved downward to further enhance the dispersing and classifying actions within the centrifugal chamber 16, thus realizing a powder classifying device which is advantageous in producing powder having sizes equal to or smaller than about several micrometers or sub-micron sized particulates.

A powder classifying device according to still yet another embodiment of the present invention is described below with reference to FIGS. 5A and 5B.

In the following, the components in FIGS. 5A and 5B which are the same as those used in the powder classifying devices shown in FIGS. 2 and 3 are denoted by the same reference numerals and symbols and their detailed description is omitted.

Figure 5B:
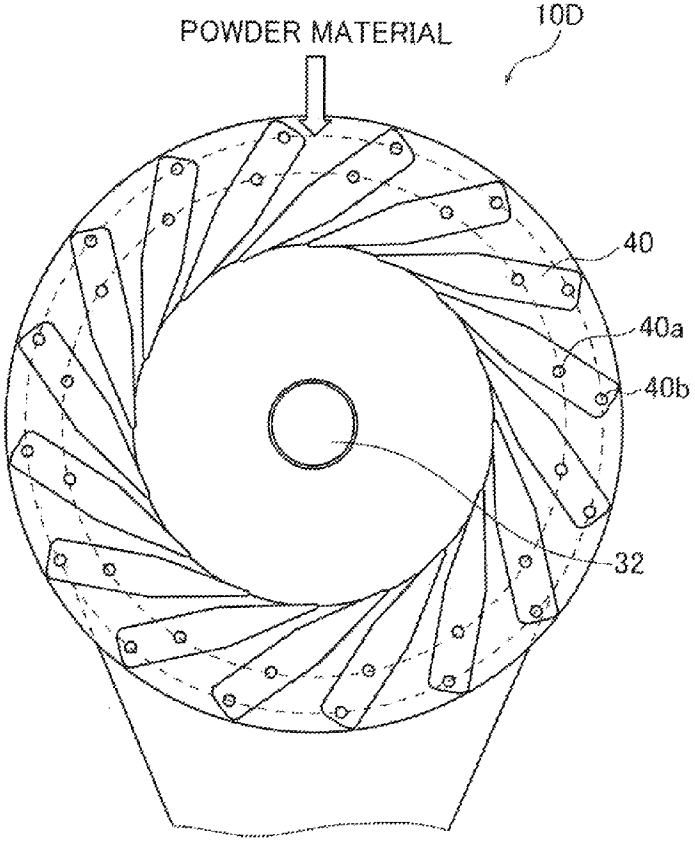
FIG. 5B is a sectional view taken along the line B-B of FIG. 5A.
Figure 5A:
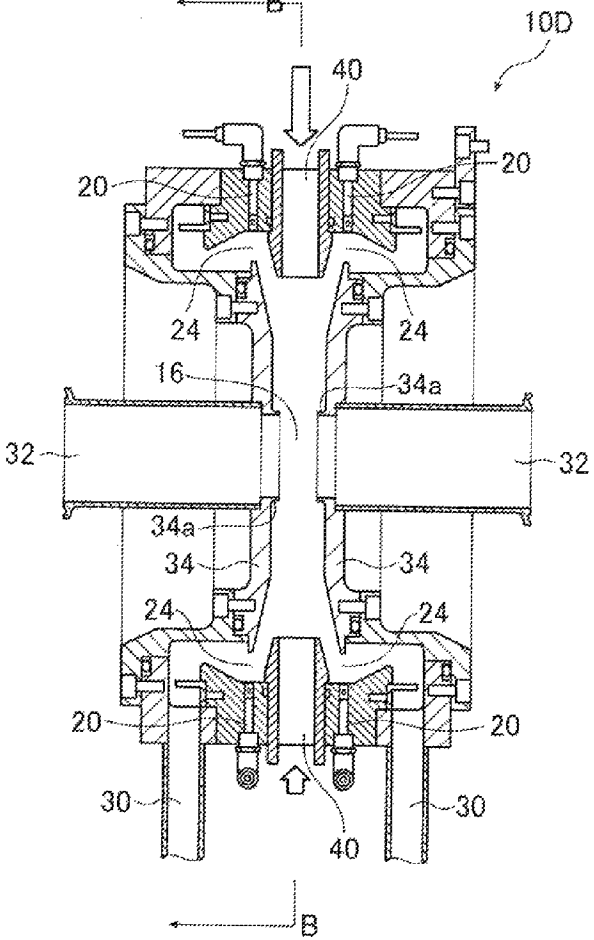
FIG. 5A is a schematic sectional view of a powder classifying device according to still yet another embodiment of the present invention taken along a plane passing through its central axis.

In the embodiment shown in FIGS. 5A and 5B, a centrifugal function unit in any of the above-mentioned embodiments which includes a centrifugal chamber 16 as its main component and is horizontally provided is rotated by 90 degrees to obtain a powder classifying device 10D in which the centrifugal function unit stands in the vertical direction.

The powder classifying device 10D according to this embodiment has been developed to improve the accuracy of the classification in view of the fact that the powder classifying devices according to the embodiments described above had certain constraints on the accuracy of the classification because the centrifugal function unit which includes the centrifugal chamber 16 as its main component is placed horizontally and, in addition to centrifugal force, gravity is applied upon centrifugal separation to powder to be treated in a direction orthogonal to the direction in which the centrifugal force is applied.

As shown in FIGS. 5A and 5B, the powder classifying device 10D according to this embodiment includes an upright disc-like centrifugal chamber 16 formed by arranging two disc-like members 34 in a face-to-face relationship while keeping a predetermined space therebetween.

A material dispersing zone 24 is formed along the outer peripheral walls of two disc-like members 34. In the material dispersing zone 24, for example, six discharge nozzles 20 for discharging high-pressure air for material dispersion are arranged on the circumference at equal intervals along the tangential direction of the outer peripheral wall of the material dispersing zone 24.

In the powder classifying device 10D according to this embodiment, the centrifugal chamber 16 is vertically arranged. The number of discharging units for discharging air containing fine particles from the centrifugal chamber 16 and the number of collection units for collecting coarse particles discharged from the centrifugal chamber 16 can be increased to two. Therefore, it is possible to improve the powder processing ability while maintaining the classification performance.

The powder classifying device according to this embodiment has an advantage that the installation area can be substantially reduced compared with the case in which the device having the same processing ability is arranged horizontally.

With the powder classifying device according to the embodiment shown in FIGS. 5A and 5B, outside air and powder material having a particle size distribution are sucked into the device through the spaces between the guide vanes 40 arranged on the outer periphery of the centrifugal chamber 16 (see white arrows) to promote the centrifugal action in the centrifugal chamber 16. In addition, the discharge nozzles 20 arranged on the outer periphery of the material dispersing zone 24 effectively prevent mixing of fine particles with coarse particles to realize a powder classifying device which is advantageous in producing powder having sizes equal to or smaller than about several micrometers or sub-micron sized particulates.

Next, a powder classifying device according to a further embodiment of the present invention is described with reference to FIG. 6.

In the following, the components in FIG. 6 which are the same as those used in the powder classifying devices shown in FIGS. 2 and 3 are denoted by the same reference numerals and symbols and their detailed explanation is omitted.

Figure 6:
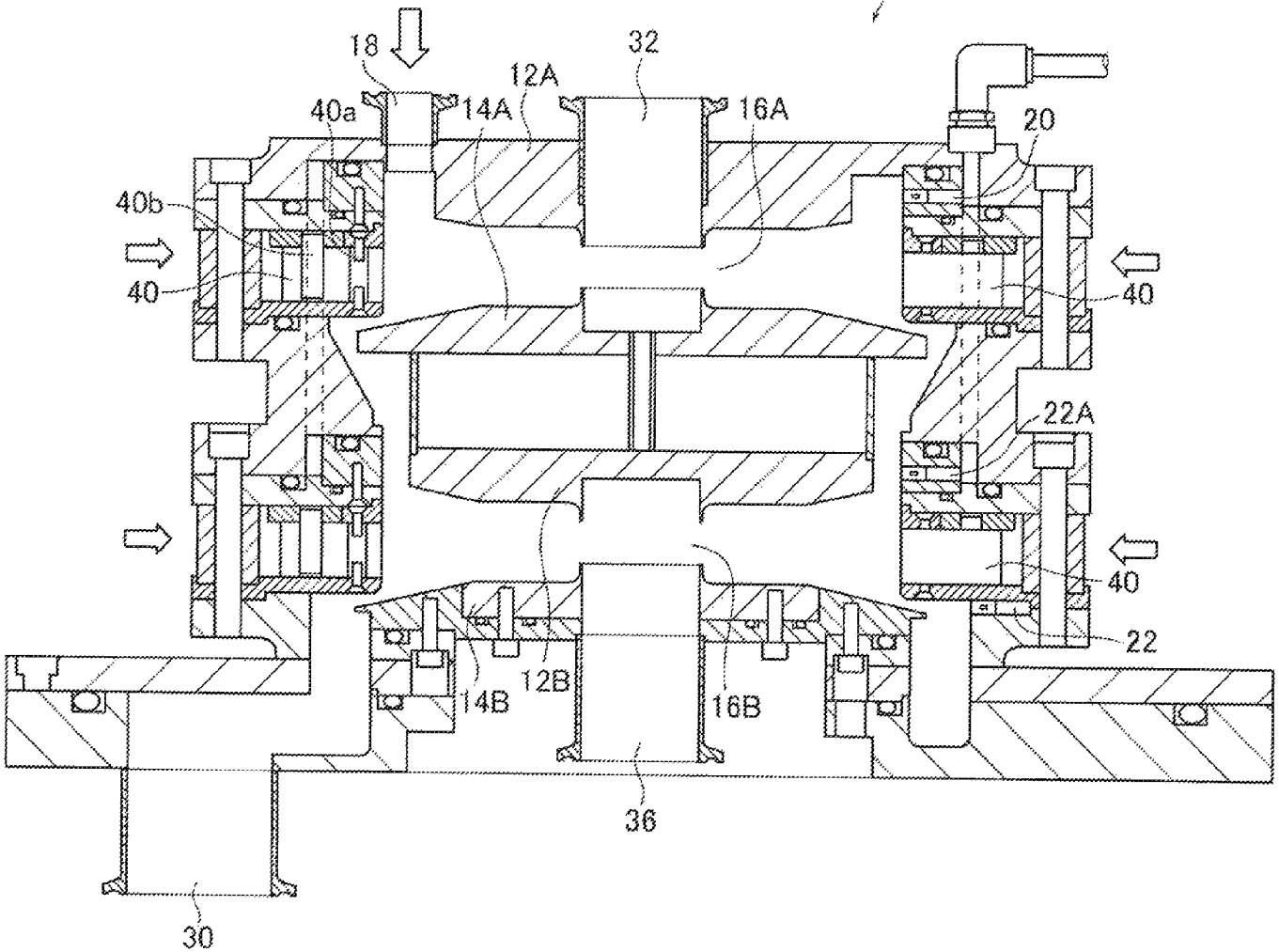
FIG. 6 is a schematic sectional view of a powder classifying device according to a further embodiment of the present invention.

A powder classifying device in the embodiment shown in FIG. 6 is capable of classification with a higher degree accuracy by disposing two powder classifying devices of the same type as shown in FIGS. 2 and 3 one on top of the other.

In a powder classifying device 10E according to this embodiment, two powder classifying devices having a function of classification at two levels are disposed vertically one on tope of the other and different classification points are set in the respective powder classifying devices to classify powder into coarse particles, medium particles, and fine particles. Consequently, it is possible to carry out more highly accurate classification.

The classification points in the respective powder classifying devices can be set by adjusting distances between the guide vanes in the respective powder classifying devices and changing the flow rate of air passing through the spaces is described above or by adjusting the amount of compressed air supplied to the centrifugal chambers (pressure and flow rate).

The powder classifying device 10E according to this embodiment includes two centrifugal chambers 16A and 16B configured by combining an upper disc-like member 12A and a lower disc-like member 14A, and an upper disc-like member 12B and a lower disc-like member 14B, respectively. The centrifugal chamber 16A located in the upper part of the device includes discharge nozzles (first nozzles) 20 and the centrifugal chamber 16B in the lower part of the device includes discharge nozzles (second nozzle 22A and third nozzles 22).

The discharge nozzles (first nozzles) 20 provided in the centrifugal chamber 16A axe discharge nozzles for use in material dispersion which are arranged on the outer peripheral wall of the centrifugal chamber 16A along the tangential direction of the outer peripheral wall. The discharge nozzles (second nozzles 22A and third nozzles 22) provided in the centrifugal chamber 16B are discharge nozzles for use in material dispersion and classification which are arranged on the outer peripheral wall of the centrifugal chamber 16B along the tangential direction of the outer peripheral wall.

The powder classifying device according to this embodiment is basically operated in the same manner as the device shown in FIG. 2 or 3. More specifically, powder introduced from the material input port 18 is first supplied into the centrifugal chamber 16A in the upper part of the device on a circulating stream of air discharged from the discharge nozzles (first nozzles) 20 in the upper powder classifying device. Then, the powder is classified in the centrifugal chamber 16A into particles having sizes equal to or smaller than the classification point set in the upper powder classifying device and particles having sizes larger than the classification point.

Part of the particles having sizes equal to or smaller than the classification point set in the upper powder classifying device are sucked from the fine particle collection port 32 by a suction blower via an appropriate filter such as a bag filter and collected in a fine particle collection unit (not shown).

On the other hand, the other particles which have not been sucked from the fine particle collection port 32 fall from the outer periphery of the lower dist-like member 14A and are sent into the lower centrifugal chamber 16B.

The particles which are in the course of falling to the lower centrifugal chamber 16B after having been moved out of the upper centrifugal chamber 16A are further centrifuged under the influence of enhanced circulating motion of air discharged from the discharge nozzles (second nozzles) 22 to be classified into particles having sizes equal to or smaller than the classification point set in the lower powder classifying device and particles having sizes larger than the classification point.

Part of the particles having sizes equal to or smaller than the classification point set in the lower powder classifying device are sucked from the medium particle collection port 36 by a suction blower via an appropriate filter such as a bag filter and collected in a medium particle collection unit (not shown).

On the other hand, the other particles which have not been sucked from the medium particle collection port 36 fall from the outer periphery of the lower disc-like member 14B and are sent into a coarse particle collection part (not shown) via the coarse particle collection port 30 located in the lower part of the device.

The discharge nozzles 22 are nozzles that discharge high-pressure air for returning particles other than the coarse particles sent from the centrifugal chamber 16B to the coarse particle collection port 30 (i.e., fine particles and medium particles), to the centrifugal chamber 16B, dispersing the particles by the action of the discharge nozzles 22A, and accelerating the centrifugal action in the centrifugal chamber 16B.

With the powder classifying device according to this embodiment, classification can be made at three levels according to the procedure described above. More specifically, the particle size distribution can be narrowed for the coarse particles or fine particles. In this case, the classification point set in the upper powder classifying device and that set in the lower powder classifying device can be adjusted to achieve various classification patterns.

The powder classifying device according to this embodiment has an advantage that the installation area can be reduced to about half compared with the case in which two devices having the same processing ability are horizontally assembled.

EXAMPLE

A specific example is described below.

The powder classifying device 10A having the configuration shown in FIG. 2 was used in Example 1, and a powder classifying device obtained by removing the two types of nozzles including the first and second discharge nozzles 20 and 22 and the ring-like edges 12*a* and 14*a* provided on the upper side and the lower side of the centrifugal chamber 16 from the powder classifying device 10A having the configuration shown in FIG. 2 was used as a conventional powder classifying device in Comparative Example 1.

The inclination angle of the guide vanes 40 from the tangential direction of the outer peripheral wall toward the center of the centrifugal chamber 16 within the powder classifying device was set to 10 degrees in both Example 1 and Comparative Example 1.

In Example 1, the pressure of air discharged from the upper and lower discharge nozzles 20 and 22 was set to 0.5 MPa and the flow rate of air discharged pet nozzle was set to 25 L/min (the total flow rate for the twelve nozzles was set to 300 L/min).

Particles made of polyester resin were used as the material to be classified. The material had an average particle size of 5.4 μm. Particles having sizes equal to or smaller than 3 μm were present at a ratio of 49% in terms of the number of particles. Particulates having excessively small sizes as a result of grinding were removed to obtain uniform-sized particles.

Air was sucked with a blower at a air flow rate of 2 $m^3$/min to classify the material under the condition of a processing capacity of 2 kg/h and collect the classified particles from the fine particle collection port 32.

Figure 7:
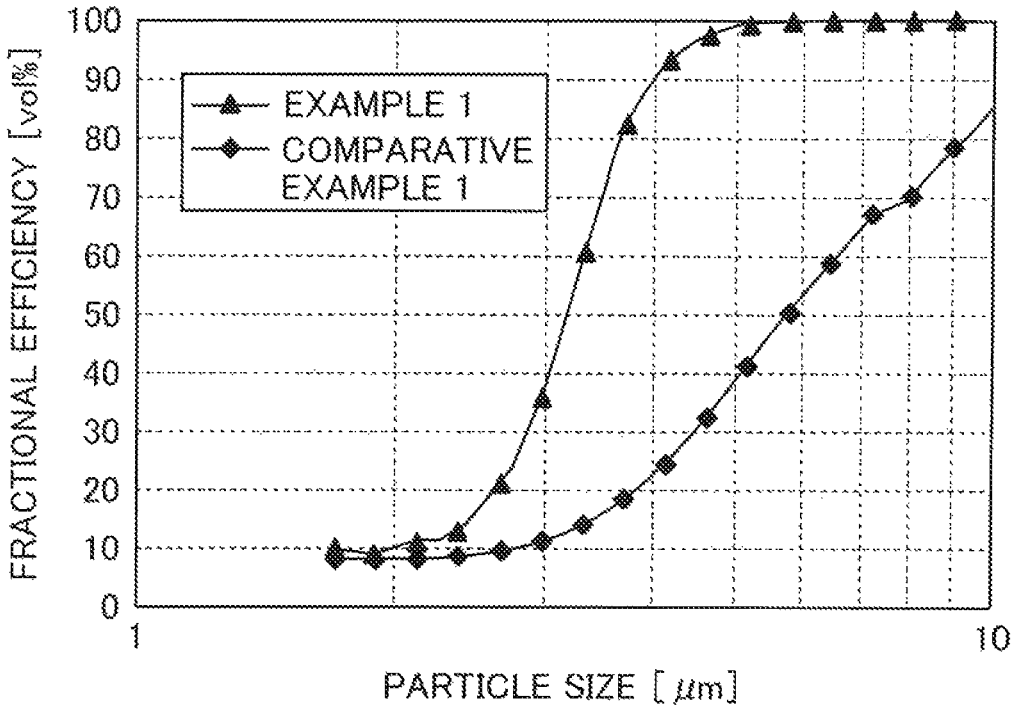
FIG. 7 is a graph for explaining the effect of Example.

After the processing had been finished, the classification results from the powder classifying devices in Example 1 and Comparative Example 1 were obtained in terms of fractional efficiency, and the ratio of particulates in the classified coarse particles was compared between Example 1 and Comparative Example 1 (see FIG. 7).

As is seen from the fractional efficiency shown in FIG. 7, the particle size distribution curve obtained by the powder classifying device used in Example 1 is extremely sharp compared with the case of the powder classifying device used in Comparative Example 1.

Table 1 shows the yield of classified coarse particles and the ratio of number of particulates with sizes of up to 3 μm included in the classified coarse particles. The device used in Example 1 achieved a yield substantially twice as large as that in the device used in Comparative Example 1 and could reduce the number of particulates with sizes of up to 3 μm.

TABLE 1

| | Yield of classified coarse particles [%] | Ratio of number of particulates with sizes of up to 3 μm [%] |
|---|---|---|
| Example 1 | 93 | 13 |
| Comparative Example 1 | 47 | 17 |

From the results described above, it is understood that, with the powder classifying device according to the present invention, particulates having sizes equal to or smaller than about several micrometers or sub-micron sized particulates can be classified with a high degree of accuracy.

The powder classifying device according to the present invention has no movable element and is therefore of a simple structure. Control of the classification point only requires adjustment of the angle of the guide vanes and the amount of air discharged from the discharge nozzles in the powder classifying device, so the powder classifying device of the present invention is easy to use.

It should be understood that the embodiments and Example are all, shown by way of illustration only and are not construed as limiting the present invention and that various improvements and modifications are possible without departing from the scope and spirit of the present invention.

What is claimed is:

1. A powder classifying device which classifies powder having a particle size distribution and having been supplied and collects the classified powder, said powder classifying device comprising:

an upper disc-shape member and a lower disc-shape member having respective inner surfaces being circular and substantially flat, which is arranged in substantially parallel in a face-to-face relationship while keeping a predetermined space between the inner surfaces and form therebetween a circular cavity to which the powder having the particle size distribution is supplied and where the supplied powder is classified, and which is a circular and substantially flat open free space having a substantially constant height and forms a material classifying zone configured as a static component;

a powder supply port for supplying the powder having the particle size distribution directly downward to an outer periphery of the circular cavity, said powder supply port being provided and opened in the upper disc-shape member so as to reach to an inside of the circular cavity from an upper surface of the upper disc-shape member;

a plurality of guide vanes arranged in a height position which is the same as a height position of the circular cavity so as to extend from a circumference of the circular cavity in an inner direction at a predetermined angle, and for sucking outside air through spaces between the plurality of guide vanes from an outside of said powder classifying device to promote a centrifugal action of the powder supplied into the circular cavity;

a discharge unit for air streams including fine particles, having sizes equal to or smaller than a classification point, discharged from the circular cavity;

a coarse particle collection unit for collecting coarse particles having a particle size more than the particle size of the fine particles that are discharged from the circular cavity and that are not discharged through the discharge unit;

a plurality of air nozzles that are arranged below the plurality of guide vanes and the material classifying zone on a circumferential wall of a lower side of the circular cavity along a tangential direction of the circumferential wall and blow compressed air into an inside of the circular cavity to return fine particles not discharged to the discharge unit and present among coarse particles having sizes exceeding the classification point at a coarse particle collection unit side of the circular cavity, to the material classifying zone of the circular cavity; and a suction blower connected to the discharge unit, wherein the discharge unit comprises a fine particle collection unit for collecting the fine particles, wherein the powder supply port is provided and opened in a direction substantially perpendicular to the upper surface of the upper disc-shape member at a position of the outer periphery of the circular cavity formed by an inner envelope of the plurality of guide vanes so as to communicate directly with the inside of the circular cavity and the powder supplied from the powder supply port is supplied directly downward to the circular cavity, wherein the plurality of guide vanes a provided so as to wholly cover the circumference of the circular cavity and a circumferential portion of the plurality of guide vanes is directly led to the outside of said powder classifying device, and wherein the outside air in the outside of said powder classifying device is sucked by the suction blower into the circular cavity through spaces between the plurality of guide vanes and discharged from the circular cavity through the discharge unit so that a circulating stream for classifying the powder is formed in the material classifying zone of the circular cavity.

2. The powder classifying device according to claim 1, wherein a direction in which the air streams are guided is integrally adjustable with the plurality of guide vanes.

3. The powder classifying device according to claim 1, further comprising a ring-shaped edge provided in a central portion of at least one of an upper surface and a lower surface in the circular cavity.

4. The powder classifying device according to claim 1, wherein at least one of the plurality of air nozzles is provided so as to communicate with the powder supply port.

5. The powder classifying device according to claim 1, wherein the discharge unit is provided in and coupled to a central portion of the circular cavity.

6. The powder classifying device according to claim 1, wherein the plurality of air nozzles blow the compressed air into a space between the plurality of guide vanes and the lower disc-shape member at the coarse particle collection unit side of the circular cavity to return the fine particles present in the space between the plurality of guide vanes and the lower disc-shape member to the material classifying zone of the circular cavity.

7. The powder classifying device according to claim 1, wherein the plurality of air nozzles blow the compressed air into a material re-classifying zone formed on the coarse particle collection unit side of the circular cavity and between a circumference of the lower disc-shape member positioned at the coarse particle collection unit side and the circumferential wall of the lower side of the circular cavity to return the fine particles in the material re-classifying zone.

8. The powder classifying device according to claim 1, further comprising air filters arranged on the circumferential portion of the plurality of guide vanes so as to cover spaces between the plurality of guide vanes to prevent dust from entering the powder classifying device and to reduce noise.

9. The powder classifying device according to claim 1, wherein the discharge unit is provided in a central portion of the upper disc-shape member in an upper direction substantially perpendicular to the upper surface of the upper disc-shape member and coupled directly to a central portion of the circular disc-like cavity and the coarse particle collection unit is provided under the lower disc-shape member.

10. The powder classifying device according to claim 9, further comprising a ring-shaped lower edge provided in a central portion of a lower surface in the circular cavity, wherein the ring-shaped lower edge is provided on a flat central portion of an upper surface of the lower disc-shape member in response to a circular opening coupled to the discharge unit and formed in a central portion of the upper disc-shape member in such a way that the ring-shaped lower edge extends upward from the upper surface of the lower disc-shape member toward the circular opening, an inner portion of the ring-shaped lower edge is a concave shape, and a height of the ring-shaped lower edge from the upper surface of the lower disc-shape member is such that the coarse particles whose sizes exceed the classification point in the powder are kept in the circular cavity and the fine particles having sizes equal to or smaller than the classification point are discharged from the circular cavity to the discharge unit.

11. The powder classifying device according to claim 10, further comprising a ring-shaped upper edge provided in a central portion of an upper surface in the circular cavity, wherein the ring-shaped upper edge is provided in the central portion of the lower surface of the upper disc-shape member so as to form a lower end of the circular opening in such a way that the ring-shaped upper edge extends downward from the lower surface of the upper disc-shape member toward the lower disc-shape member, and a height of the ring-shaped upper edge from the lower surface of the upper disc-shape member is together with the height of the ring-shaped lower edge such that the coarse particles whose sizes exceed the classification point in the powder are kept in the circular cavity and the fine particles having sizes equal to or smaller than the classification point are discharged from the circular cavity to the discharge unit.

12. The powder classifying device according to claim 9, wherein the powder supply port and the discharge unit are provided in the upper disc-shape member over the circular cavity, the fine particles in the powder supplied to the outer periphery of the circular cavity from the powder supply port are flowed within the circular cavity on the circulating stream, and discharged upward from a central portion of the circular cavity through the discharge unit, the coarse particles in the powder are flowed within the circular cavity on the circulating stream, discharged to an underside of the lower disc-shape member, and collected in the coarse particle collection unit.

13. The powder classifying device according to claim 1, wherein the open free space of the circular cavity are formed between the inner surfaces of the upper disc-shape member and the lower disc-shape member in such a way a space between the inner surfaces in a face-to-face relationship becomes larger in an outer side of the circular cavity apart from a central portion of the circular cavity.

* * * * *